US007911191B2

(12) United States Patent
Lewis

(10) Patent No.: US 7,911,191 B2
(45) Date of Patent: Mar. 22, 2011

(54) DROP-OUT VOLTAGE MONITORING METHOD AND APPARATUS

(75) Inventor: Michael Lewis, Märsta (SE)

(73) Assignee: Infineon Technologies AG, Munich (DE)

( * ) Notice: Subject to any disclaimer, the term of this patent is extended or adjusted under 35 U.S.C. 154(b) by 775 days.

(21) Appl. No.: 11/464,372

(22) Filed: Aug. 14, 2006

(65) Prior Publication Data

US 2008/0036436 A1 Feb. 14, 2008

(51) Int. Cl.
*G05F 1/44* (2006.01)
*G05F 1/56* (2006.01)

(52) U.S. Cl. ..... 323/273; 323/274; 323/303; 323/275

(58) Field of Classification Search ..... 323/273, 323/274, 303, 275
See application file for complete search history.

(56) References Cited

U.S. PATENT DOCUMENTS 5,191,278 A * 3/1993 Carpenter ..... 323/275
5,349,284 A * 9/1994 Whittle ..... 323/207
5,864,227 A * 1/1999 Borden et al. ..... 323/280
5,929,617 A * 7/1999 Brokaw ..... 323/280
6,320,363 B1 * 11/2001 Oglesbee et al. ..... 323/303
6,366,068 B1 * 4/2002 Morishita ..... 323/282
6,593,725 B1 * 7/2003 Gallagher et al. ..... 323/284
6,686,725 B1 * 2/2004 Choi et al. ..... 323/207
6,703,813 B1 * 3/2004 Vladislav et al. ..... 323/270
6,954,054 B2 * 10/2005 Brown ..... 323/283
7,015,680 B2 * 3/2006 Moraveji et al. ..... 323/274
7,095,215 B2 * 8/2006 Liu et al. ..... 323/222
7,215,108 B2 * 5/2007 Inn et al. ..... 323/285
7,218,086 B1 * 5/2007 Ritter et al. ..... 323/303
7,397,226 B1 * 7/2008 Mannama et al. ..... 323/273
2005/0275394 A1 * 12/2005 Moraveji et al. ..... 323/312
2007/0216383 A1 * 9/2007 Al-Shyoukh et al. ..... 323/280
2008/0054867 A1 * 3/2008 Soude et al. ..... 323/282

* cited by examiner

*Primary Examiner* — Bao Q Vu
(74) *Attorney, Agent, or Firm* — Coats & Bennett, P.L.L.C.

(57) ABSTRACT

A voltage regulator has a device for regulating an output voltage, having an input to receive an input voltage and an output to deliver an output voltage of a constant level, and a device for correcting a drop-out voltage violation, coupled to the device for regulating, to determine an occurrence of a drop-out voltage violation and to cause the device for regulating to change the level of the output voltage upon detection of the drop-out voltage violation. A method for regulating an output voltage has the steps of receiving an input voltage, generating and outputting a regulated output voltage of a constant level, monitoring occurrence of a drop-out voltage violation, and causing a change of the level of the output voltage upon detection of the drop-out voltage violation.

29 Claims, 4 Drawing Sheets

DROP-OUT VOLTAGE MONITORING METHOD AND APPARATUS

TECHNICAL FIELD

The invention relates to a voltage regulator and a voltage regulation method.

BACKGROUND

The function of a voltage regulator circuit is basically to maintain a precise voltage regardless of the current drawn by a load. FIG. 1 shows an example of a voltage regulator. This example of a voltage regulator comprises three basic components: a reference voltage source 3 (e.g. a band-gap reference) for generating a reference voltage Vref, an error amplifier circuit 4 which compares an output voltage Vout with the reference voltage Vref via the feedback resistors R1, R2 so as to determine the error in the output voltage, and an output stage 5 which regulates the output voltage according to the error amplifier output. A first resistor R1 is coupled to a node between the output stage 5 and the output port 2 of the voltage regulator and a second resistor R2 is serially coupled to the first resistor R1. An electric path is coupled to a node between the resistors R1 and R2 to tap-off a feedback voltage Vfb. The electric path and the two resistors R1 and R2 thus form a potential divider. The feedback voltage Vfb is always a particular fraction of the regulator output Vout. The error amplifier circuit further comprises an operational amplifier 4.1. A negative input of the operational amplifier 4.1 is supplied with the reference voltage Vref and a positive input of the operational amplifier 4.1 is supplied with the feedback voltage Vfb. The output of the operational amplifier 4.1 is coupled to a gate of the output stage 5.

Linear voltage regulators may require an input voltage at least some minimum amount higher than the desired output voltage. This minimum amount is called the "drop-out" voltage which is thus an important parameter of a voltage regulator. For example, a common voltage regulator has an output voltage of 5 V, but can only maintain it if the input voltage remains above about 7 V. Its drop-out voltage is therefore 7 V-5 V=2 V. When the supply voltage is less than about 2 V above the desired output voltage, the supply voltage to the regulator becomes too close to the output voltage such that the regulation properties start to degrade and the regulator can no longer hold the output voltage stable against changes in the input voltage.

There can be typically certain inaccuracies in the output voltage. An important contributing factor to this is the inaccuracy of the reference voltage Vref, particularly when using ultra low power band-gap references. Therefore, in a conventional linear regulator the minimum input voltage Vin is defined by the maximum output voltage Vout plus the drop-out voltage.

It is desirable to minimize the minimum allowable input voltage Vin. This allows a device where the regulator is connected to the battery to be operated for a longer portion of the battery discharge curve. In a system where a switched DC-DC converter supplies the input Vin, it allows the losses in the linear regulator to be minimized by minimizing the voltage drop across the regulator. This may imply that the drop-out voltage of the regulator must be kept as low as possible. However, a very low drop-out voltage may require an extremely low-resistance and physically large output device, which is undesirable in a low-cost circuit.

SUMMARY

A voltage regulator may comprise an output voltage regulation circuit, comprising an input to receive an input voltage and an output to deliver an output voltage of a constant level, and a drop-out voltage violation correction circuit, coupled to the output voltage regulation circuit, to detect an occurrence of a drop-out voltage violation and to cause the output regulation circuit to change the level of the output voltage upon detection of the drop-out voltage violation.

BRIEF DESCRIPTION OF THE DRAWINGS

Embodiments of the invention are better understood with reference to the following drawings.

DETAILED DESCRIPTION

Figure 1:
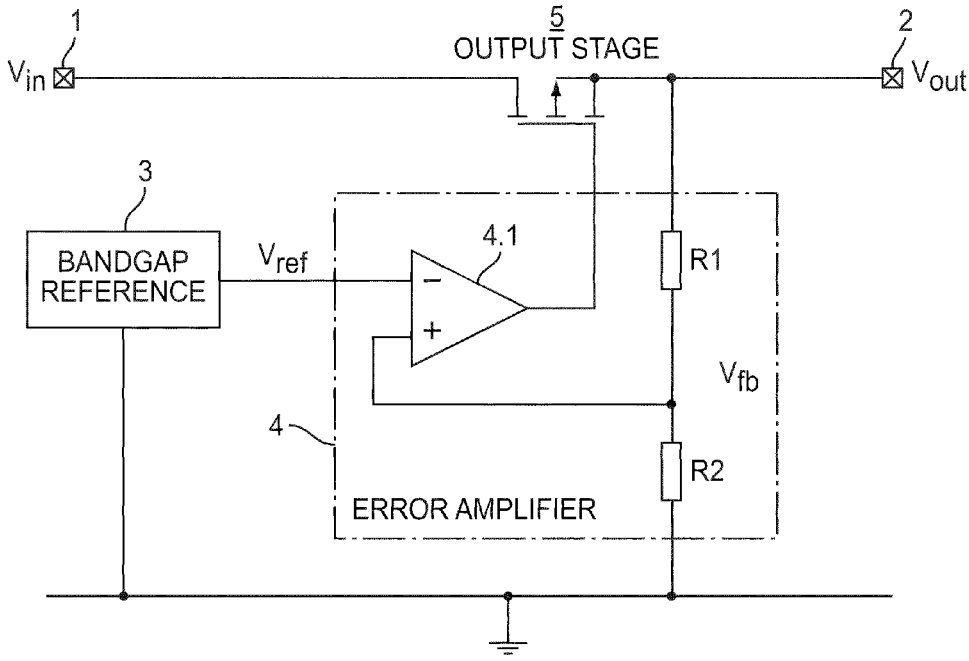
FIG. 1 (PRIOR ART)
FIG. 1 is a block diagram of a conventional voltage regulator.

Different aspects and embodiments are described with reference to the drawings, wherein like reference numerals are generally utilized to refer to like elements throughout. In the following description, for purposes of explanation, numerous specific details are set forth in order to provide a thorough understanding of one or more aspects of embodiments of the invention. It may be evident, however, to one skilled in the art that one or more aspects of the embodiments of the invention may be practiced with a lesser degree of the specific details. In other instances, known structures and devices are shown in block diagram form in order to facilitate describing one or more aspects of the embodiments of the invention. The following description is therefore not to be taken in a limiting sense, and the scope of the invention is defined by the appended claims.

Figure 2:
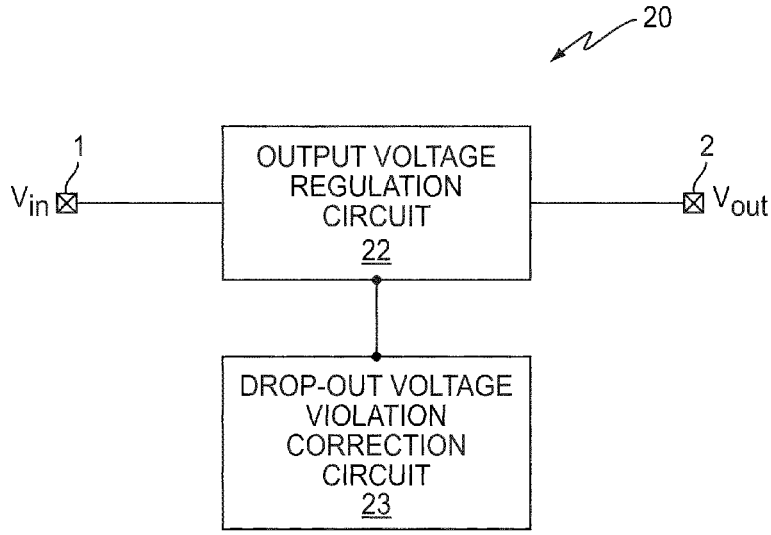
FIG. 2 is a block diagram of an embodiment of a voltage regulator.

Referring to FIG. 2, there is shown an embodiment of a voltage regulator. The voltage regulator 20 comprises an input port 1 for supplying an input voltage Vin to the voltage regulator 20 and an output port 2 for delivering an output voltage Vout. The input voltage Vin is supplied to the input of an output voltage regulation circuit 22 the purpose and function of which is to generate and maintain a precise and constant output voltage Vout. The output voltage Vout is delivered to an output of the output voltage regulation circuit 22 from where it is delivered to the output port 2 of the voltage regulator 20.

The output voltage regulation circuit 22 fulfills its function to generate and maintain a precise and constant output voltage Vout as long as the drop-out voltage, in particular the difference between the input voltage Vin and the output voltage Vout, is above a predetermined level. If, for reasons like degradation of the input power of a battery, the input voltage Vin decreases, then as a result also the drop-out voltage decreases. When the drop-out voltage decreases below the above-mentioned predetermined drop-out voltage level, the voltage regulator 20 can no longer hold the output voltage Vout stable and constant.

Therefore, the output voltage regulation circuit 22 is coupled to a drop-out voltage violation correction circuit 23 the purpose and function of which is to detect the occurrence of a drop-out voltage violation and to cause the output regulation circuit 22 to change the level of the output voltage Vout upon detection of a drop-out voltage violation. A drop-out voltage violation is essentially the decrease of the drop-out voltage below the above-mentioned predetermined level. Therefore, the function of the drop-out violation correction circuit aims to correct the drop-out voltage violation and to bring the drop-out voltage back into an allowable range, namely above the predetermined level. In particular, this is accomplished by causing the output regulation circuit 22 to reduce the level of the output voltage Vout for an amount so as to bring back the drop-out voltage into the allowable range, namely above the predetermined level.

Figure 3:
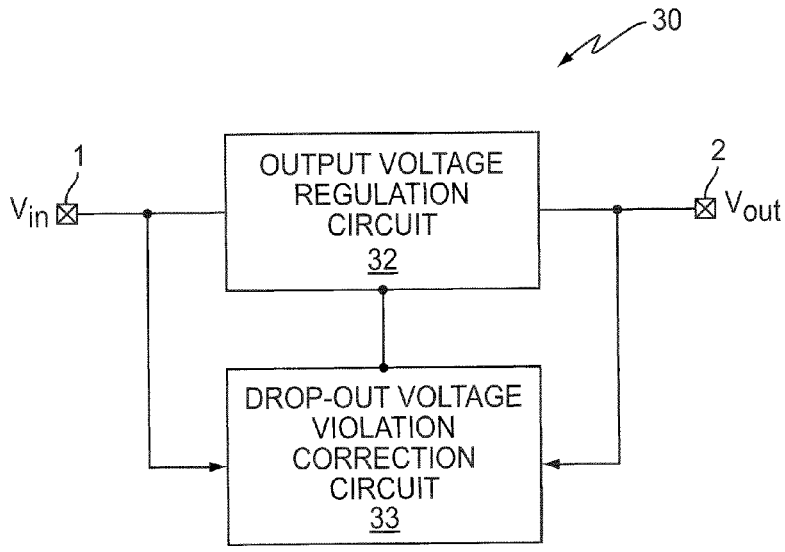
FIG. 3 is a further embodiment of a voltage regulator.

Referring to. FIG. 3, there is shown a further embodiment of a voltage regulator 30 which is similar to the embodiment of FIG. 2. In this embodiment the drop-out voltage violation correction circuit 33 has a first input to receive the input voltage Vin and a second input to receive the output voltage Vout. In the drop-out voltage violation correction circuit 33 it can be determined on the basis of the supplied voltage values whether a drop-out voltage violation occurs. In the situation of a drop-out voltage violation the output regulation circuit 32 is caused to change the level of the output voltage.

With the embodiments of voltage regulators of FIGS. 2 and 3 a method for regulating an output voltage can be performed. In this method an input voltage Vin is received by the output voltage regulation circuit 22 or 32, respectively. A regulated output voltage Vout of a constant level is generated and outputted by the output voltage regulation circuit 22 or 32, respectively. The occurrence of a drop-out voltage violation is monitored by the drop-out violation correction circuit 23 or 33, respectively, and a change of the level of the output voltage upon detection of a drop-out voltage violation is caused by the drop-out voltage violation correction circuit 23 or 33, respectively.

Figure 4:
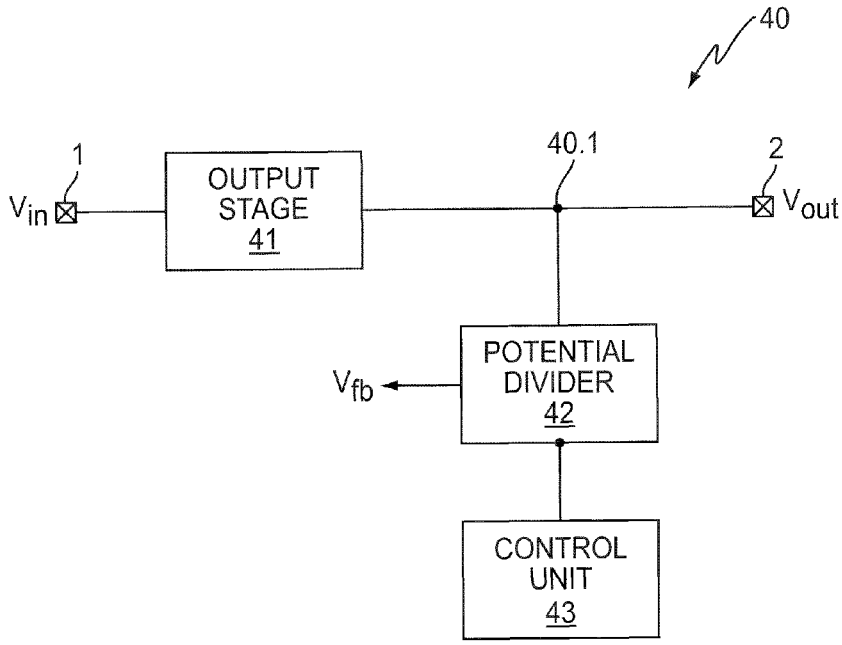
FIG. 4 is a further embodiment of a voltage regulator.

Referring to FIG. 4, there is shown a further embodiment of a voltage regulator. The voltage regulator 40 comprises an output stage 41 coupled between an input port 1 and an output port 2. With the output stage 41 the current flow between the input port 1 and the output port 2 can be controlled. The voltage regulator 40 further comprises a potential divider 42 which is coupled to a first node 40.1 between the output stage 41 and the output port 2. The potential divider 42 allows to tap-off a feedback voltage Vfb which is to be used for the regulation of the output voltage Vout. A control unit 43 is coupled to the potential divider 42 to control the potential divider 42 upon receipt of a signal indicating a drop-out voltage violation to change the level of the feedback voltage Vfb and the level of the output voltage Vout. The feedback voltage Vfb is normally a particular fraction of the output voltage Vout and is thus representative of the output voltage Vout. Therefore, it can be used to stabilize the output voltage Vout by generating a control voltage derived from the feedback voltage Vfb and to drive the output stage 41 with the control voltage. A signal indicating a drop-out voltage violation is received by the control unit 43 and the control unit 43 thereupon controls the potential divider 42 to change the level of the feedback voltage Vfb and as a consequence also the level of the output voltage Vout. In particular, the potential divider 42 acts to reduce the level of the feedback voltage Vfb so that also the level of the output voltage Vout is reduced. As a consequence, the drop-out voltage is brought back into a range above a predetermined value.

With the embodiment of a voltage regulator according to FIG. 4, the following method for regulating an output voltage can be performed. An input voltage Vin is received by the output stage 41 and a regulated output voltage Vout of a constant level is generated and outputted by the output stage 41. From the output voltage Vout a feedback voltage Vfb is generated by the potential divider 42. The feedback voltage Vfb is used for regulating the output voltage Vout. Upon receiving a signal indicating a drop-out voltage violation by the control unit 42, the level of the feedback voltage Vfb is changed and thus the level of the output voltage Vout is also changed. In particular, the levels of the feedback voltage Vfb and the output voltage Vout are reduced.

Figure 5:
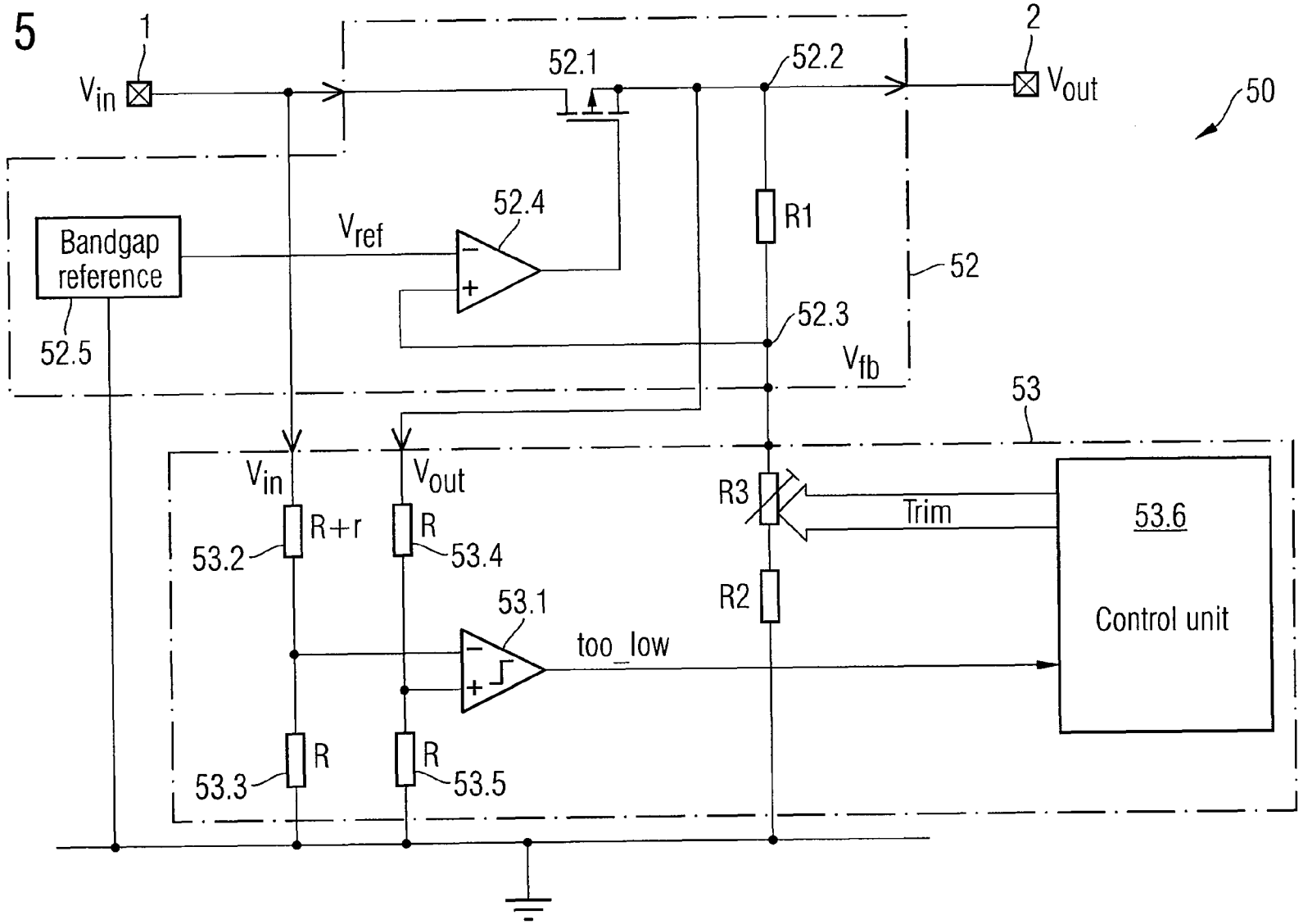
FIG. 5 is a further embodiment of a voltage regulator showing with dashed and chain-dotted lines the circuits of the embodiment of FIG. 2 with further details.

Referring to FIG. 5, there is shown a further embodiment of a voltage regulator. The embodiment of FIG. 5 is a further development of the embodiment of FIG. 3. In particular, the output voltage regulation circuit 32 as shown in FIG. 3 corresponds to the output voltage regulation circuit 52 (surrounded by the dashed line) in FIG. 5 and the drop-out voltage violation correction circuit 33 of FIG. 3 corresponds to the drop-out voltage violation correction circuit 53 (surrounded by the chain-dotted line) of FIG. 5. However, as compared to FIG. 3, the output voltage regulation circuit 52 and the drop-out voltage violation correction circuit 53 are depicted with some more details of their circuit configuration.

The output voltage regulation circuit 52 comprises an input which is coupled to the input port 1 to supply the input voltage Vin to the output voltage regulation circuit 52. The input voltage Vin is then provided to an output stage 52.1 the function of which is to control the current flow between the input and the output of the output voltage regulation circuit 52. The output stage 52.1 may be implemented as a metal oxide semiconductor field-effect transistor (MOSFET), in particular a self-blocking MOSFET, as shown in FIG. 5 in a preferable implementation. Between the output of the output stage 52.1 and the output of the output voltage regulation circuit 52 there is provided a first node 52.2. A first resistor R1 is coupled to the first node 52.2 with one of its terminals. The other terminal of the resistor R1 is coupled to a second node 52.3. Also coupled to the second node 52.3 is an electric line to tap-off a feedback voltage Vfb which is a fraction of the output voltage Vout. The electric line is coupled to the positive input of an operational amplifier 52.4 to supply the positive input with the feedback voltage Vfb. The output voltage regulation circuit 52 also comprises a band-gap reference voltage source 52.5 which outputs a reference voltage Vref. The reference voltage Vref is supplied to the negative input of the operational amplifier 52.4. The output of the operational amplifier 52.4 is coupled to the gate of the output stage 52.1.

The output voltage regulation circuit 52 is coupled to a drop-out voltage violation correction circuit 53. The drop-out voltage violation correction circuit 53 comprises a second resistor R3 comprising a variable and programmable resistance value. The second resistor R3 is coupled with one of its terminals with the second node 52.3 of the output voltage regulation circuit 52. The other terminal of the second resistor R3 is coupled to one of the terminals of a third resistor R2. The other terminal of the third resistor R2 is coupled to ground. The first resistor R1, the second node 52.3, the electric line coupled to the second node 52.3 and the second resistor R3 form together a potential divider. Moreover, the potential divider has variable properties as one of its constituents, namely the second resistor R3 has a variable and programmable resistance value. In particular, if the resistance value of the second resistor R3 is increased, then also the potential at the second node 52.3 is increased so that the feedback voltage Vfb which is tapped off at the second node 52.3 and supplied to the positive input of the operational amplifier 52.4 is also increased. An increase of the feedback voltage Vfb is considered by the output voltage regulation circuit 52 as a respective increase of the output voltage Vout which is in fact not the case as the output voltage Vout has remained constant. As a result, the output voltage regulation 52 reacts so as to decrease the output voltage Vout in order to have the same feedback voltage Vfb as before. Hence, an increase of the resistance value of the second resistor R3 leads to a decrease of the output voltage Vout and thus to an increase of the drop-out voltage. The second resistor R3 may comprise a network of resistors which may be programmed with a digital bit word from the control unit 53.6 to obtain a desired resistance value.

The drop-out voltage violation correction circuit 53 comprises two inputs one of which is for supplying the input voltage Vin and the other one is for supplying the output voltage Vout. The voltage values Vin and Vout are supplied to a comparator circuit comprising a comparator 53.1 and four resistors 53.2, 53.3, 53.4, and 53.5. A fourth resistor 53.2 comprising a resistance value R+r and a fifth resistor 53.3 comprising a resistance value R are connected in series wherein the fourth resistor 53.2 receives the input voltage Vin and the fifth resistor 53.3 is connected with one of its terminals to the fourth resistor 53.2 and with its other terminal to ground. Between the fourth resistor 53.2 and the fifth resistor 53.3 there is provided a node which is connected to the negative input of the comparator 53.1. A sixth resistor 53.4 comprising a resistance value R and a seventh resistor comprising a resistance value R are connected in series wherein the sixth resistor 53.4 receives the output voltage Vout and the seventh resistor 53.5 is connected with one of its terminals to the sixth resistor 53.4 and with its other terminal to ground. Between the sixth resistor 53.4 and the seventh resistor 53.5 there is provided a node which is connected to the positive input of the comparator 53.1. The comparator 53.1 thus compares a voltage which is representative of the input voltage Vin with another voltage which is representative of the output voltage Vout.

If the comparator 53.1 detects that the difference between the voltages input to its positive and negative inputs is below a certain predetermined threshold, it outputs a signal "too_low". This signal "too_low" is transmitted to a control unit 53.6. The control unit 53.6 then generates and outputs a trim signal to the second variable resistor R3.

The voltage regulator thus allows a lower minimum input voltage Vin for a given voltage regulator drop-out voltage. The comparator 53.1 compares the input voltage Vin and the output voltage Vout (or voltages representative to the input and output voltages) and indicates with the signal "too_low" to the control unit 53.6 if the condition is detected that the input voltage Vin is too low so that the drop-out voltage would be violated. If this condition is detected, the second variable resistor R3 is programmed by the control unit 53.6 to set the output voltage to a lower value as described above. Typically, this procedure would only be enabled at specific instances and be semi-static so as to avoid any dynamic instability in the calibration mechanism.

In the embodiment of FIG. 5, as explained above, a resistive divider network of fourth to seventh resistors 53.2 to 53.5 is used to compare the input and output voltages. The ratios of the resistive dividers may be chosen such that, with the second variable resistor R3 at its minimum value, the comparator generates the signal "too_low" when the input voltage Vin is at the lowest allowable value and the drop from Vin to Vout is just crossing the lowest safe value. Other ratios may be chosen as an alternative.

This procedure does guarantee that, as long as the input voltage Vin is within its specified range, inaccuracies in the reference voltage Vref do not cause the drop-out voltage to be exceeded. In the event that Vref is instead too low, the signal "too_low" and the reduction of the output voltage will never be activated, thereby not effecting the accuracy at the lower limit of the output voltage.

In order to deal with variations of the reference and input voltages with time, it is desirable to periodically detect if the trimming can be reduced. This can be done by occasionally attempting to back-off the trimming until the signal "too_low" is indicated, and/or by including a separate comparator that detects when the input voltage is much higher than the output voltage.

Figure 6:
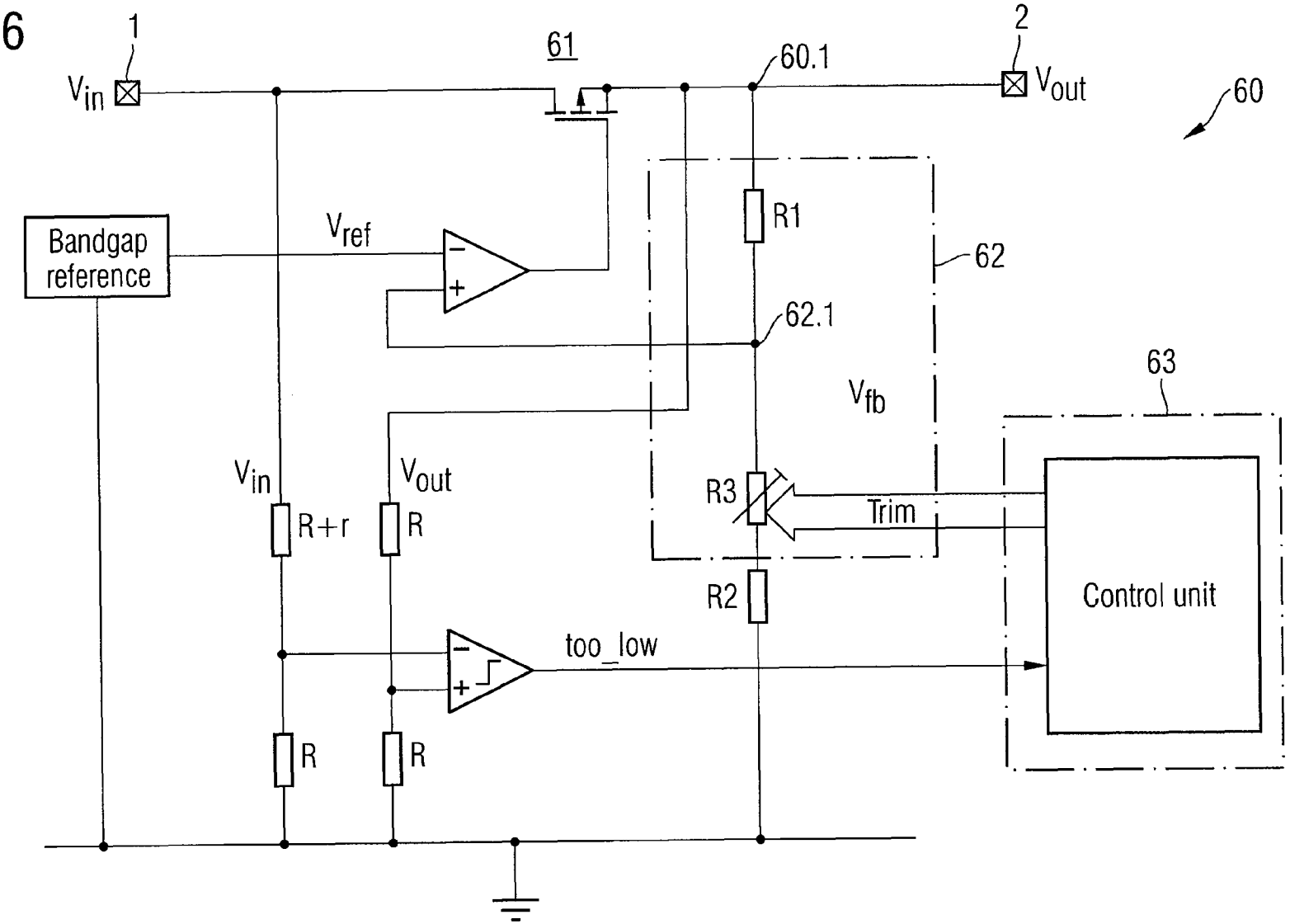
FIG. 6 the same embodiment of a voltage regulator as shown in FIG. 5 showing within dashed line the circuit of the embodiment of FIG. 4 with further details.

Referring to FIG. 6, there is shown an embodiment of a voltage regulator which is virtually identical to the embodiment as shown in FIG. 5. In fact, FIG. 6 shows the same circuit configuration as FIG. 5, but FIG. 6 shows another way of grouping particular circuit elements together in order to compare it with the embodiment as depicted in FIG. 4. The voltage regulator 40 as shown in FIG. 4 comprises an output stage 41 which is comparable to the output stage 61 of the voltage regulator 60 in FIG. 6. In FIG. 4 there are shown a potential divider 42 and a control unit 43, both in block form. In FIG. 6 the respective circuit parts are represented in more detail. The potential divider 62 of the voltage regulator 60 is comparable to the potential divider 42 of the voltage regulator 40 in FIG. 4. In FIG. 6 the potential divider 62 is coupled to a first node 60.1 provided between the output of the output stage 61 and the output port 2. The potential divider 62 comprises a first resistor R1, a second node 62.1, an electric line coupled to the second node 62.1 and a second variable resistor R3. The control unit 63 which is comparable to the control unit 43 in FIG. 4 is coupled with the second variable resistor R3 in order to program the second resistor R3 to a higher value for programming a higher output voltage Vout in case of a drop-out voltage violation.

What is claimed is:

1. A voltage regulator, comprising:

an output voltage regulation circuit, comprising an input to receive an input voltage and an output to deliver an output voltage of a constant level, and a drop-out voltage violation correction circuit, coupled to the output voltage regulation circuit, to detect an occurrence of a drop-out voltage violation and to cause the output regulation circuit to change the level of the output voltage upon detection of the drop-out voltage violation.

2. A voltage regulator according to claim 1, further comprising:

an input port, coupled to the input of the output voltage regulation circuit, to supply the input voltage to the output voltage regulation circuit, and an output port, to deliver the output voltage.

3. A voltage regulator according to claim 1, wherein the output voltage regulation circuit comprises:

an output stage coupled between the input and the output of the output voltage regulation circuit, to control the current flow between the input and the output of the output voltage regulation circuit.

4. A voltage regulator according to claim 3, wherein the output voltage regulation circuit comprises:

a first resistor, coupled to a first node between the output stage and the output of the output voltage regulation circuit, and an electric line, coupled to a second node between the first resistor and the drop-out voltage violation correction circuit, to tap-off a feedback voltage to be used for regulation of the output voltage.

5. A voltage regulator according to claim 4, wherein the drop-out voltage violation correction circuit comprises:

a variable resistor coupled to the first resistor via the second node, and a control unit, coupled to the variable resistor, to control the resistance value of the variable resistor upon receipt of a signal indicating the drop-out voltage violation.

6. A voltage regulator according to claim 3, wherein the drop-out voltage violation correction circuit comprises:

a first input, coupled to the input port, to supply the input voltage to the drop-out voltage violation correction circuit, a second input, coupled to the output of the output stage, to supply the output voltage to the drop-out voltage violation correction circuit, and a comparator circuit, coupled to the first input and to the second input, to detect the occurrence of a drop-out voltage violation from values of the input voltage and the output voltage.

7. A voltage regulator, comprising:

means for regulating an output voltage, comprising an input to receive an input voltage and an output to deliver an output voltage of a constant level, and means for correcting a drop-out voltage violation, coupled to the means for regulating, to determine an occurrence of a drop-out voltage violation and to cause the means for regulating to change the level of the output voltage upon detection of the drop-out voltage.

8. A voltage regulator according to claim 7, comprising:

an input port, coupled to the input of the means for regulating, to supply the input voltage to the means for regulating, and an output port, to deliver the output voltage.

9. A voltage regulator according to claim 7, wherein the means for regulating comprises:

first means for controlling, coupled between the input and the output of the means for regulating, to control the current flow between the input and the output of the means for regulating.

10. A voltage regulator according to claim 9, wherein the means for regulating comprises:

a first resistor, coupled to a first node between the first means for controlling and the output of the means for regulating, and an electric line, coupled to a second node between the first resistor and the means for correcting, to tap-off a feedback voltage to be used for regulation of the output voltage.

11. A voltage regulator according to claim 10, wherein the means for correcting comprises:

a variable resistor, coupled to the first resistor via the second node, and second means for controlling, coupled to the variable resistor, to control the resistance value of the variable resistor upon receipt of a signal indicating the drop-out voltage violation.

12. A voltage regulator according to claim 9, wherein the means for correcting comprise:

a first input, coupled to the input port, to supply the input voltage to the means for correcting, a second input, coupled to the output of the first means for controlling, to supply the output voltage to the means for correcting, and means for comparing, coupled to the first input and to the second input, to detect the occurrence of a drop-out voltage violation from the input voltage and the output voltage.

13. A voltage regulator, comprising:

an input port to supply an input voltage to the voltage regulator, an output port to deliver an output voltage, an output stage, coupled between the input port and the output port, a potential divider, coupled to a first node between the output stage and the output port, to tap-off a feedback voltage to be used for regulation of the output voltage, and a control unit, coupled to the potential divider, to control the potential divider upon receipt of a signal indicating the drop-out voltage violation, to change the level of the feedback voltage and the level of the output voltage.

14. A voltage regulator according to claim 13, wherein the potential divider comprises:

a first resistor, coupled to the first, a variable resistor, coupled to the first resistor, and an electric line coupled to a second node between the first resistor and the variable resistor, to tap-off the feedback voltage at the second node, wherein the control unit is coupled to the variable resistor to vary the resistance value of the variable resistor upon receipt of the signal indicating the drop-out voltage violation.

15. A voltage regulator according to claim 13, further comprising:

a comparator circuit, coupled to the input port and the output of the output stage, to detect the occurrence of a drop-out voltage violation and to generate the signal indicating the drop-out voltage violation.

16. A voltage regulator according to claim 13, further comprising:

a reference voltage generator, to generate a reference voltage of a constant level, a comparator, comprising:

a first input, coupled to the reference voltage generator, a second input, coupled to the second node, and an output, coupled to a control input of the output stage.

17. A method for regulating a voltage, comprising:

receiving an input voltage, generating and outputting a regulated output voltage of a constant level, monitoring the occurrence of a drop-out voltage violation, and causing a change of the level of the output voltage upon detection of the drop-out voltage violation.

18. A method according to claim 17, further comprising:

detecting the occurrence of the drop-out voltage violation, if a difference between the input voltage and the output voltage falls below a predetermined threshold.

19. A method according to claim 18, further comprising:

supplying the input voltage and the output voltage to a comparator circuit, to compare the input voltage with the output voltage, or a voltage representative of the input voltage with a voltage representative of the output voltage.

20. A method according to claim 17, further comprising:

generating a feedback voltage from the output voltage, and using the feedback voltage for generating the regulated output voltage.

21. A method according to claim 20, further comprising:

generating the feedback voltage by dividing the output voltage by use of a potential divider.

22. A method according to claim 20, further comprising:

generating a reference voltage, and comparing the reference voltage with the feedback voltage, and adapting the output voltage if the comparing yields a difference between the reference voltage and the feedback voltage.

23. A method according to claim 20, further comprising:

changing the level of the feedback voltage upon detection of a drop-out voltage violation, and causing a change of the level of the output voltage.

24. A method for regulating an output voltage, comprising:

receiving an input voltage, generating and outputting a regulated output voltage of a constant level, generating a feedback voltage from the output voltage, using the feedback voltage for regulating the output voltage, and changing the level of the feedback voltage and the level of the output voltage upon receiving a signal indicating a drop-out voltage violation.

25. A method according to claim 24, further comprising:

monitoring occurrence of the drop-out voltage violation, and generating the signal indicating the drop-out voltage violation in case of detecting the drop-out voltage violation during the monitoring.

26. A method according to claim 25, further comprising:

detecting the occurrence of the drop-out voltage violation, if a difference between the input voltage and the output voltage falls below a predetermined threshold.

27. A method according to claim 26, further comprising:

supplying the input voltage and the output voltage to a comparator circuit, to compare the input voltage with the output voltage, or a voltage representative of the input voltage with a voltage representative of the output voltage.

28. A method according to claim 24, further comprising:

generating the feedback voltage by dividing the output voltage by use of a potential divider.

29. A method according to claim 24, further comprising:

generating a reference voltage, comparing the reference voltage with the feedback voltage, and adapting the output voltage if the comparing yields a difference between the reference voltage and the feedback voltage.

* * * * *